US006005341A

United States Patent [19]

Park et al.

[11] Patent Number: 6,005,341

[45] Date of Patent: Dec. 21, 1999

[54] SHIELD FOR A CATHODE RAY TUBE

[75] Inventors: Jae-kyu Park; Sang-yoon Park, both of Kyongsangbuk-do, Rep. of Korea

[73] Assignee: LG Electronics Inc., Seoul, Rep. of Korea

[21] Appl. No.: 08/959,728

[22] Filed: Oct. 28, 1997

[30] Foreign Application Priority Data

| | | | |
|---|---|---|---|
| Oct. 31, 1996 | [KR] | Rep. of Korea | 96-50720 |
| Nov. 26, 1996 | [KR] | Rep. of Korea | 96-57312 |
| Nov. 26, 1996 | [KR] | Rep. of Korea | 96-57313 |

[51] Int. Cl.[6] ..... H01J 29/80

[52] U.S. Cl. ..... 313/479; 313/402; 313/407

[58] Field of Search ..... 313/479, 402, 313/407, 326, 239

[56] References Cited

U.S. PATENT DOCUMENTS

| | | | |
|---|---|---|---|
| 4,472,657 | 9/1984 | Sakurai et al. | 313/402 |
| 5,397,958 | 3/1995 | Na | 313/479 X |

*Primary Examiner*—Ashok Patel
*Attorney, Agent, or Firm*—Finnegan, Henderson, Farabow, Garrett & Dunner L.L.P.

[57] ABSTRACT

A CRT comprising a front panel coated with a fluorescent layer on the inner surface thereof, a shadow mask, a mask frame separating the shadow mask at a distance from the front panel, a funnel extending outwardly from the front panel forming an envelope surrounded by the front panel and the funnel, and an inner shield inside such an envelope to shield against earth and other external magnetic fields. The mask frame and the inner shield are welded together at their ends.

9 Claims, 4 Drawing Sheets

SHIELD FOR A CATHODE RAY TUBE

BACKGROUND OF THE INVENTION

A. Field of the Invention

The present invention relates to a CRT (Cathode Ray Tube), and more particularly to a structure of a magnetic shield provided in a CRT to shield against the earth magnetic field and the external magnetic field.

B. Discussion of the Related Art

Referring to FIGS. 1 and 2, a flat CRT comprises a panel 2 provided on the front surface of the CRT. A fluorescent screen 9, which is coated with a fluorescent substance, is provided on the inner surface of the panel 2 to emit visible light when struck by electron beams. A funnel 3 is fixedly attached to the rear of the panel 2 by fusion with a frit glass. An external shield 6 is coupled to the CRT by a reinforcement band 10. The band 10 is provided on a connection member of the panel 2 and the funnel 3.

An electron gun 5 is provided in a neck 3*a* of the funnel 3 to emit three electron beams of three primary colors, red, green and blue. A shadow mask 7 is mounted on the inner surface of the panel 2 and perforated with numerous tiny holes of slit shapes to ensure that each of the three electron beams strikes only its intended color fluorescent dot. A frame 8 is provided to separate the shadow mask 7 from the panel 2 at a distance.

The electron beams 4, which are emanated from the electron gun 5, pass through respective holes of the shadow mask 7 and strike the fluorescent screen 9, which is coated with a fluorescent substance on the inner side of panel 2, to emit visible light. The external shield 6 reduces the extent of the deflection defocusing of the electron beams which may be caused by the earth magnetic field and/or the external magnetic field.

Referring to FIG. 3, the external shield 6 comprises a funnel flange 6-1 and a panel flange 6-2. The funnel flange 6-1 extends along the circumference of the funnel 3 towards the neck 3*a* of the funnel 3. The panel flange 6-2 provides contact with the panel 2. Since the external shield 6 is made of magnets, the external magnetic field introduced into the CRT tends to easily flow through the external shield 6, reducing the above-described deflection defocusing effect caused by the external magnetic field.

Referring to FIG. 2, a portion A refers to a situation in which the panel flange 6-2 of the external shield 6 mounted on the CRT tends to cover a portion of the viewing screen of the panel 2. In this situation, the panel flange 6-2 must be cut short, as shown in FIG. 1, after the external shield 6 is mounted on the CRT. This cutting process is cumbersome and inconvenient. Further, the external shield 6 is typically thin, and therefore when it is mounted on the outside of the CRT, it tends to be deformed.

Yet further, the external shield 6 is a major cost factor in making CRTs because it has to be drawn along the shape of the funnel during manufacturing.

SUMMARY OF THE INVENTION

An object of the present invention is to overcome disadvantages of the prior art system in shielding a CRT from the earth and/or external magnetic fields.

Another object of the present invention is to provide a shield which is not easily deformed and securely attached to the frame of the CRT.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, a CRT, as embodied and broadly described, comprises a front panel having a light illuminating layer on its inner surface; a shadow mask adjacent the inner surface of the front panel; a funnel attached to the front panel forming an envelope surrounded by the funnel and the front panel; and an inner shield adjacent the shadow mask and inside such an envelope to shield against external magnetic fields.

It is to be understood that both the foregoing general description and the following detailed description are exemplary and explanatory and are intended to provide further explanation of the invention as claimed.

The accompanying drawings, which are incorporated in and constitute a part of this specification, illustrate one embodiment of the invention and together with the description, serve to explain the principles of the invention.

BRIEF DESCRIPTION OF THE ATTACHED DRAWINGS

DETAILED DESCRIPTION OF PREFERRED EMBODIMENT

Reference will now be made in detail to the preferred embodiment of the present invention, example of which is illustrated in the accompanying drawings.

An embodiment of the present invention is described with reference to FIGS. 4 through 7.

Figure 1:
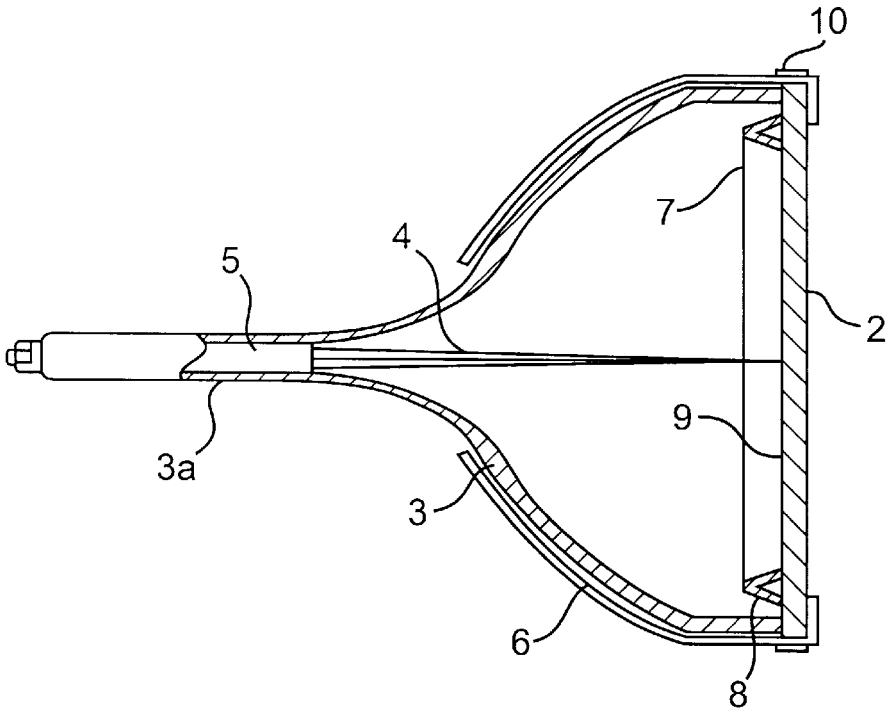
FIG. 1 PRIOR ART
FIG. 1 is a cross-sectional view of a conventional flat CRT.
Figure 2:
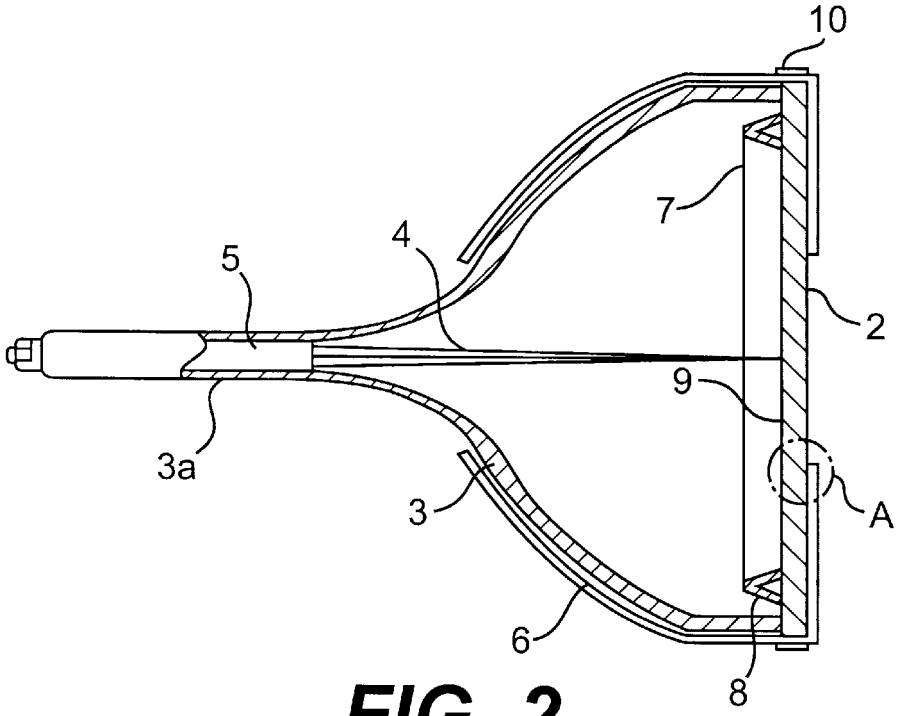
FIG. 2 PRIOR ART
FIG. 2 is a cross-sectional view of another conventional flat CRT of prior art.
Figure 3:
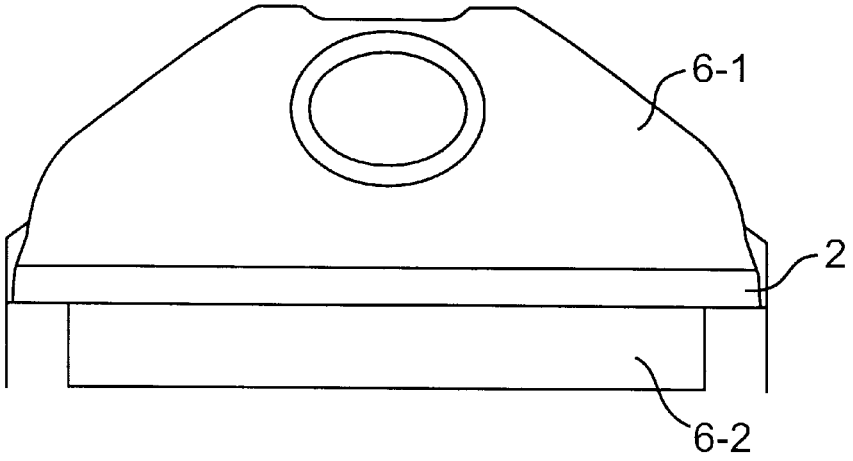
FIG. 3 PRIOR ART
FIG. 3 shows the external shield of the conventional flat CRT.
Figure 4:
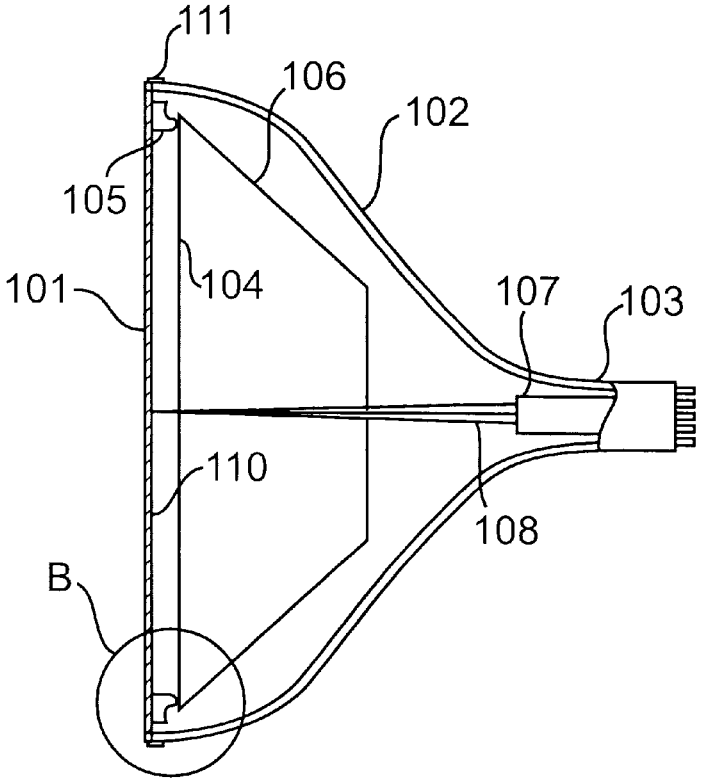
FIG. 4 is a cross-sectional view of a flat CRT according to an embodiment of the present invention.

Referring to FIG. 4, a CRT, preferably a flat color CRT, of the present invention, as embodied herein, has a panel 101 having an inner fluorescent surface 110. The panel 101 is coupled to a shadow mask 104, which has a plurality of perforated tiny holes for electron beams to pass through. A shadow mask frame 105 separates the shadow mask 104 from the panel 101 at a distance. The rear end of the panel 101 is attached to a funnel 102. The inner space of the funnel 102 maintains a vacuum state. An electron gun 107 is enveloped inside a neck 103 of the funnel 102 to generate electron beams 108 to shield against the earth magnetic field. An inner shield 106 is fixedly attached, preferably by welding, to the frame 105, and disposed inside the funnel 102.

Figure 5:
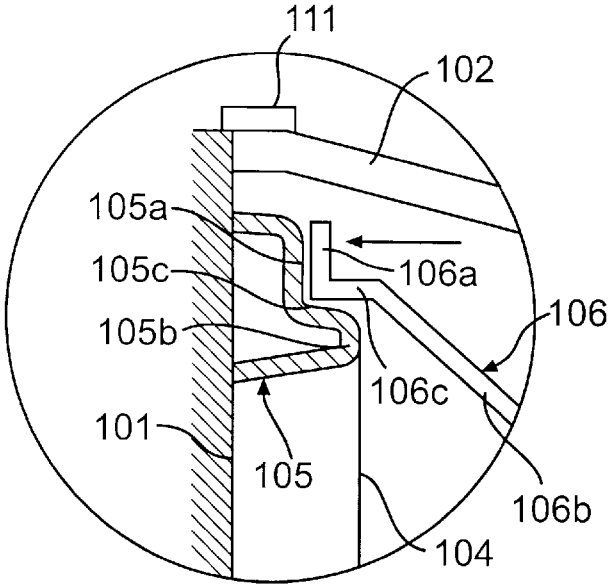
FIG. 5 is an exploded view of a portion B of the flat CRT of FIG. 4.
Figure 7:
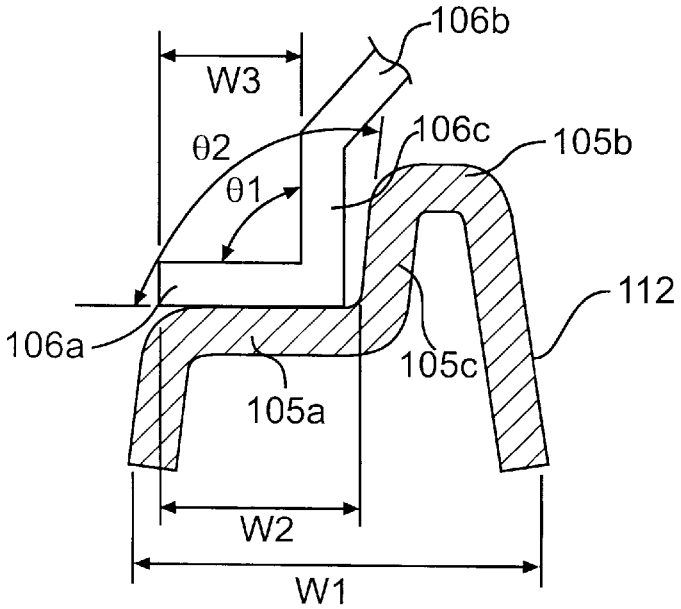
FIG. 7 is an exploded view of the welded portion of the inner shield of the flat CRT of FIG. 4.
Figure 6A:
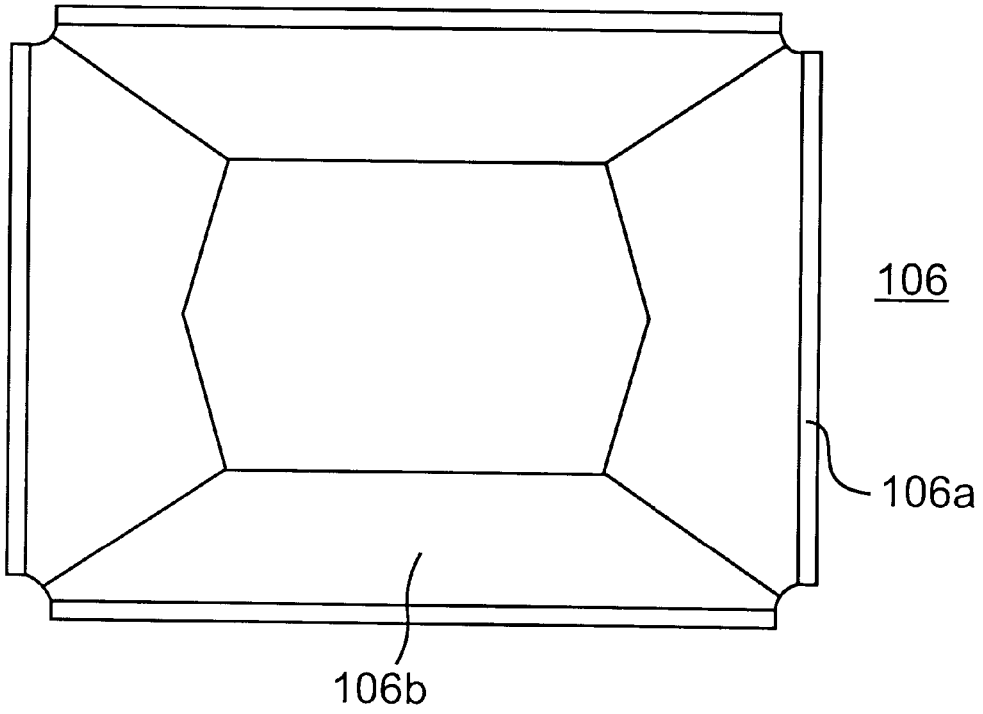
FIG. 6A is a plan view of the inner shield of the flat CRT of FIG. 4.
Figure 6B:
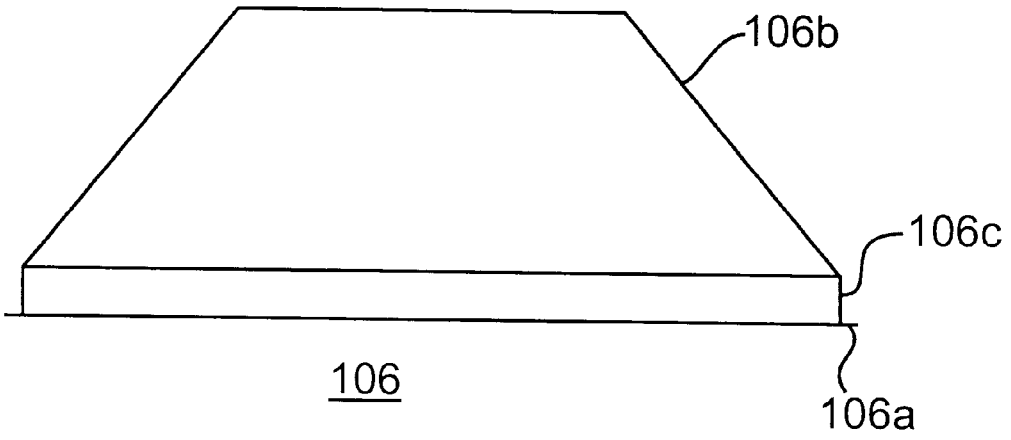
FIG. 6B is a side view of the inner shield of the flat CRT of FIG. 4.

FIG. 5 is an exploded view of a portion B of FIG. 4. FIGS. 6A and 6B are plan and side views of the inner shield 106, respectively. Referring to FIGS. 5, 6A and 6B, the frame 105 comprises a first flange 105*a*, which is substantially parallel with the surface of the panel 101; a mask fixing member 105*b*; and a slant portion 105*c*, which connects the first flange 105*a* to the mask-fixing member 105*b*. The inner shield 106, as shown in FIGS. 6A and 6B, comprises a second flange 106*a* which extends outwardly to be welded together with the first flange 105*a*; an extension member 106*b*, which is shaped along the inner curved surface of the funnel 102; and a connection member 106*c*, which connects the second flange 106*a* to the extension member 106*b*. The first flange 105*a* of the frame 105, which is welded together with the second flange 106*a* of the inner shield, is preferably coated with nickel 112 (as shown in FIG. 7). A reference numeral 111 refers to a reinforcement band.

The operation of the above-constructed flat CRT according to the embodiment of the present invention is described as follows.

Referring to FIG. 5., the frame 105 is fixedly attached to the inner surface of the panel 101 to support the shadow mask 104. The frame 105 has the first flange 105*a* which is welded to the inner shield 106. The inner shield 106 is firmly welded to the first flange 105*a* at several different portions, preferably by a laser welding or an arc welding, to ensure that the inner shield 106 is not separated from the first flange 105*a* and does not vibrate during the operation of the CRT.

Further, the first flange 105*a* of the frame 105 is preferably coated with nickel to facilitate welding with the shadow mask 104 and the inner shield 106 which are typically made of iron. Because of this superior welding, those welded points are not dropped out thus causing no friction with one another. This absence of friction causes thin blackened films to disappear, thus significantly reducing discharge and/or mask stoppage.

Referring to FIG. 7, an angle $\theta_1$ between the second flange 106*a* of the inner shield 106 and the connection member 106*c* is preferably smaller than or equal to an angle $\theta_2$ between the first flange 105*a* of the frame 105 and the slant portion 105*c*. Further, FIG. 7 shows how the inner shield 106 is welded to the frame 105. The first flange 105*a* of the frame 105 has a small width $W_2$. The width $W_2$ is defined by the structural relationship between the size of the panel 101 and the effective area for welding, and made small limited by an entire width $W_1$ of the frame 105. Accordingly, the second flange 106*a* of the inner shield 106 has a width $W_3$ which is between 80% and 120% of the width W2 of the first flange 105*a* of the frame 105.

When the width $W_3$ of the second flange 106*a* is smaller than 80% of the width $W_2$ of the first flange 105*a*, it is difficult to weld the first flange 105*a* to the inner shield 106. If the width $W_3$ is above 120% of the width $W_2$, the second flange 106*a* of the inner shield 106 tends to touch the funnel 102, possibly resulting in undesirable discharge caused by exfoliation of the inner shield 106.

According to the present invention as described above, the possible deformation of the inner shield is avoided and the effective area for welding between the inner shield and the mask frame is maximized.

It will be apparent to those skilled in the art that various modifications and variations can be made in a device for shielding earth magnetic field of a flat CRT according to the present invention without departing from the spirit or scope of the invention. Thus, it is intended that the present invention cover the modifications and variations of this invention provided they come within the scope of the appended claims and their equivalents.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A cathode ray tube, comprising:

a front panel having a light illuminating layer on its inner surface;

a shadow mask adjacent said inner surface of the front panel;

a funnel attached to the front panel forming an envelope surrounded by said funnel and the front panel;

an inner shield adjacent said shadow mask and inside said envelope to sheild against external magnetic fields; and a stair-shaped mask frame inside said envelope for separating said shadow mask at a distance from said front panel.

2. The cathode ray tube of claim 1, wherein said envelop maintains substantially a vacuum state.

3. The cathode ray tube of claim 1, wherein said inner shield includes a nickel.

4. The cathode ray tube of claim 1, wherein said stair-shaped mask frame includes a first flange adjacent the shadow mask, a second flange adjacent said inner shield, and a connecting member between the first flange and the second flange.

5. The cathode ray tube of claim 1, wherein said stair-shaped mask frame and said inner shield have portions which are fixedly attached to one another.

6. The cathode ray tube of claim 1, wherein said stair-shaped mask frame and said inner shield are at least partially welded together.

7. The cathode ray tube of claim 4, wherein said inner shield includes a first flange extending along and adjacent said front panel, a second flange extending away from said front panel along said funnel, and a connecting member between the first flange and the second flange.

8. The cathode ray tube of claim 7, wherein an angle between the first flange and the connecting member of said inner shield is smaller than or equal to an angle between the first flange and the connecting member of said mask frame.

9. The cathode ray tube of claim 7, wherein a width of the first flange of the inner shield is between 80% and 120% of a width of the first flange of the mask frame.

* * * * *

UNITED STATES PATENT AND TRADEMARK OFFICE

CERTIFICATE OF CORRECTION

PATENT NO.: 6,005,341

DATED: December 21, 1999

INVENTORS: Jae-kyu PARK et al.

It is certified that an error appears in the above-identified patent and that said Letters Patent is hereby corrected as shown below:

Claim 1, Column 4, line 27, "sheild" should read --shield--.

Signed and Sealed this

Fifth Day of December, 2000

*Attest:*

Q. TODD DICKINSON

*Attesting Officer*

*Director of Patents and Trademarks*